US005439231A

United States Patent [19]

Roberts et al.

[11] Patent Number: 5,439,231

[45] Date of Patent: Aug. 8, 1995

[54] ARCHERY ARROW VANE AND NOCK ASSEMBLY

[75] Inventors: Kent S. Roberts; Brent J. Roberts, both of American Fork, Utah

[73] Assignee: Inventive Technology, American Fork, Utah

[21] Appl. No.: 1,273

[22] Filed: Jan. 7, 1993

[51] Int. Cl.[6] ..... F41B 5/18; F42B 6/06

[52] U.S. Cl. ..... 273/423; 273/416; 124/35.2; 124/31

[58] Field of Search ..... 124/35.1, 35.2, 36, 124/37, 31; 273/416, 420, 423

[56] References Cited

U.S. PATENT DOCUMENTS

| | | | |
|---|---|---|---|
| 1,542,159 | 6/1925 | Maxwell | 124/35.2 |
| 2,417,791 | 6/1944 | Tyszkiewicz | 124/35 |
| 2,488,597 | 4/1946 | Konold | 124/35 |
| 2,637,311 | 8/1950 | Rose | 124/35 |
| 2,936,749 | 3/1958 | Chellstorp | 124/35 |
| 2,977,952 | 5/1959 | Gabriel et al. | 124/35 |
| 3,749,076 | 7/1973 | Suski | 124/35.2 |
| 4,134,369 | 1/1979 | Cook . | |
| 4,266,782 | 5/1981 | Patterson | 273/423 |
| 4,544,163 | 10/1985 | Scanlon | 273/416 |
| 4,645,211 | 2/1987 | Beiter | 273/416 |
| 4,706,965 | 11/1987 | Schaar | 273/416 |
| 4,829,974 | 5/1989 | Anderson . | |
| 4,874,180 | 10/1989 | Fingerson et al. | 273/416 |
| 4,958,617 | 9/1990 | Anderson . | |
| 4,958,838 | 9/1990 | Farler | 273/423 |
| 5,020,508 | 6/1991 | Greene, Jr. | 124/35.2 |
| 5,067,731 | 11/1991 | Bickel | 273/416 |
| 5,119,797 | 6/1992 | Anderson | 273/416 |
| 5,154,432 | 10/1992 | Saunders | 273/416 |

FOREIGN PATENT DOCUMENTS

| | | | |
|---|---|---|---|
| 77683 | 2/1962 | France | 124/37 |

OTHER PUBLICATIONS

Photograph showing three prior art molded fletching units.

*Primary Examiner*—Anthony Knight

*Attorney, Agent, or Firm*—Mallinckrodt & Mallinckrodt

[57] ABSTRACT

A vane and nock assembly for use with an archery arrow shaft to make an archery arrow includes an elongate body with a plurality of vanes extending from and along the body. An arrow shaft is attached to the front of the assembly so that the vanes extend therebehind. A nock may be removably mounted to the rearward end of the assembly or may be integral with the assembly. The nock may be cooperable with a release device so the release device can hold the nock and drawing force can be applied to a bow string of an archery bow through the release device and nock held thereby to thereby draw a bow. The use of the nock and cooperating release device is not limited to use with the vane and nock assembly.

19 Claims, 2 Drawing Sheets

ARCHERY ARROW VANE AND NOCK ASSEMBLY

BACKGROUND OF THE INVENTION

1. Field

The invention is in the field of archery arrows, nocks, and drawing and release devices for archery bows.

2. State of the Art

Current normal practice in preparation or fletching of archery arrows is to glue vanes, usually of flexible plastic, but still in some instances of feather, to the rearward portion of an arrow shaft, now generally made of aluminum or carbon fiber composite material. A nock is secured to the arrow shaft at its rearward end behind the vanes, and an arrowhead is secured to the arrow shaft at its forward end. When a vane becomes damaged, the damaged vane can be removed and a new vane glued to the arrow shaft. When fletching an arrow (putting the vanes on the arrow) it is important that the vanes be properly spaced and aligned. This spacing and alignment is difficult for individual archers, without specialized equipment, to maintain. Thus, when a vane on an arrow becomes damaged, many archers will replace the complete arrow rather than attempting to replace one or more vanes.

Vane assemblies have been marketed, particularly for wooden childrens' archery arrows, and recently for aluminum crossbow arrows, wherein the vanes are molded on a plastic sleeve as a complete unit which slides onto and fits over the rearward end portion of an arrow shaft. Some of these assemblies merely include the vanes and a nock is separately inserted into or is otherwise formed at the rearward end of the arrow shaft. Other of these assemblies include an integrally molded nock so when the sleeve is slid over the rearward end portion of an arrow shaft, the end of the shaft remains in the assembly and the assembly forms the nock for the end of the arrow. With such assemblies, however, it has apparently been considered important to maintain the integrity of the arrow shaft itself through the length of the vanes since all such assemblies known to the inventors have a sleeve which fits over the arrow shaft for substantially the entire length of the vanes, i.e., the rearward end of the arrow shaft is received in the assembly and extends through the assembly for the length of the vanes. Applicants are not aware of any such assemblies which extend behind the arrow shaft and effectively extend the length of the arrow by the length of the vanes.

Archery releases known to the inventors all have some type of gripping or holding means that hold the bow string as it is being drawn. Where the bow string is held in a location below the nock of the arrow, the string will be angled in the arrow nock and upon release of the string, the angle will exert at least a slight initial downward pressure on the end of the arrow. Several of the newer string releases, see for example U.S. Pat. No. 5,020,508, grip the string both above and below the arrow nock in an attempt to avoid this problem.

SUMMARY OF THE INVENTION

According to the invention, applicants have found that an effective vane assembly for an archery arrow can be provided to extend beyond the rearward end of the arrow shaft with a nock provided rearwardly of the vanes. In other words, the vanes are located between the rearward end of the arrow shaft and the nock, rather than along the rearward portion of the arrow shaft itself. This eliminates a sleeve fitting over a significant portion of the arrow shaft, yet still allows a unitary vane assembly to be easily installed at the rearward end of an arrow shaft and to be easily replaced if a vane becomes damaged or a different vane configuration is desired. While this effectively extends the length of the arrow by about the length of the vanes, and requires the assembly to maintain the structural integrity of the arrow between the rearward end of the arrow shaft and the nock, this has not been found to be a problem.

In a preferred embodiment of the invention, the vane assembly includes an elongate body with vanes projecting from the body and extending along at least a portion of the length of the body. Generally, either three or four vanes will extend radially out from the body equally spaced about the circumference of the body and may extend parallel to the arrow axis along the length of the body, as is normal, or may extend at an angle to the arrow axis to impart a spin to the arrow. An arrow shaft attachment means, such as a reduced diameter extension of the body to fit into the rearward end of a hollow arrow shaft or an opening into which the rearward end of an arrow shaft is inserted, is provided at the forward end of the body and a nock means, such as a reduced diameter extension of the body over which a nock can be secured or an opening into which a nock can be inserted, is provided at the rearward end of the body. Rather than having a separate nock secured to the body, the nock means could be integrally molded with the assembly. The vanes may be substantially rigid or may be flexible as with currently used vanes.

In a further aspect of the invention, the nock may be configured to cooperate with a release device, similar to known bow string release devices, but modified so that the arrow nock may be held by such device rather than the bow string being held. The bow is drawn by drawing the arrow back with the device, thereby drawing the bow string received in the arrow nock. It has been found that by holding and drawing the arrow rather than the bow string, the forces exerted upon the arrow by the bow string upon release from a drawn condition of the bow are straighter resulting in straighter arrow flight than when the string is held and drawn directly. When drawing the bow by holding the arrow nock rather than the bow string, it is preferred that the bow string receiving slot in the arrow nock be curved to some extent to smoothly receive the bow string without sharp bends in the bow string. Generally an even curve will be desired to provide even, straight forces to the arrow upon release, but, if desired, an uneven curve can be provided to provide downward or upward forces on the end of the arrow.

When used with a release device, it is presently preferred that the nock be configured with a rounded receiving groove extending circumferentially around the nock to receive a mating ridge provided in opposing jaws of a release device which surround opposing side portions of the hock when in closed, holding position.

The invention includes a modified release device to be used cooperably with a mating nock for drawing the bow. Further, the nock and release device of the invention can be used without using the vane and nock assembly of the invention.

THE DRAWINGS

The best mode presently contemplated for carrying out the invention in actual practice is illustrated in the accompanying drawings, in which:

FIG. 1 is a side elevation of an arrow including the vane and nock assembly of the invention;

FIG. 2, a fragmentary vertical axial section taken along the line 2—2 of FIG. 1, and drawn to a larger scale;

FIG. 3, a transverse vertical section taken along the line 3—3 of FIG. 2;

FIG. 4, a transverse vertical section taken along the line 4—4 of FIG. 2; and drawn to a larger scale;

FIG. 5, a side elevation of the parts of an assembly of the invention and part of the arrow shaft with which it is used showing how such parts go together, the surface of some portions of the parts being broken away;

FIG. 6, a perspective view of a second embodiment of an assembly ,of the invention;

FIG. 7, a vertical axial section of a third embodiment of an assembly of the invention;

FIG. 8, a side elevation of a further embodiment of the nock of the invention;

FIG. 9, an axial section taken on the line 9—9 of FIG. 8;

FIG. 10, a vertical section through a release device of the invention and showing fragmentarily the nock of FIG. 8 as held by the release device; and FIG. 11, a front elevation of the release device of FIG. 10, but without the nock therein.

DETAILED DESCRIPTION OF THE ILLUSTRATED EMBODIMENT

Figure 1:
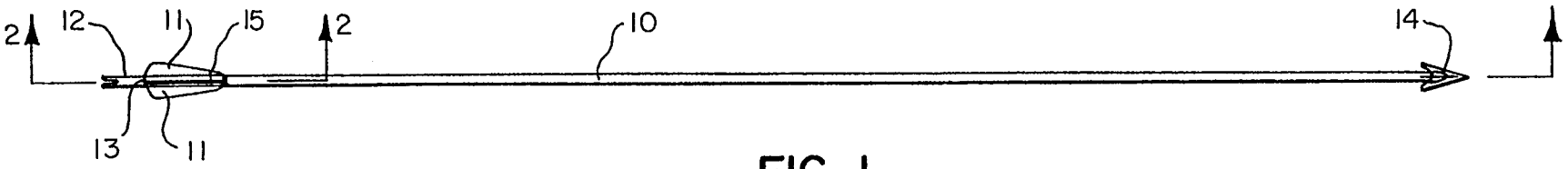

An archery arrow generally includes an arrow shaft 10, FIG. 1, a plurality of vanes 11 mounted on the rearward portion of the arrow, a nock 12 at the rearward end of the arrow with bow string receiving groove 13 therein to receive the bow string of an archery bow, and arrow head 14 at the forward end of the arrow. In the prior art, the vanes are usually secured directly to the rearward portion of the arrow shaft itself, such as by gluing such vanes to the arrow shaft, and the nock is secured to the rearward end of the arrow shaft. However, as illustrated in FIG. 1, the present invention provides an arrow vane and nock assembly which is secured to the rearward end of the arrow shaft so that the vanes, rather than extending along a rearward portion of the arrow shaft itself, are positioned behind the rearward end of the arrow shaft and between the rearward end of the arrow shaft and the nock.

Figure 6:
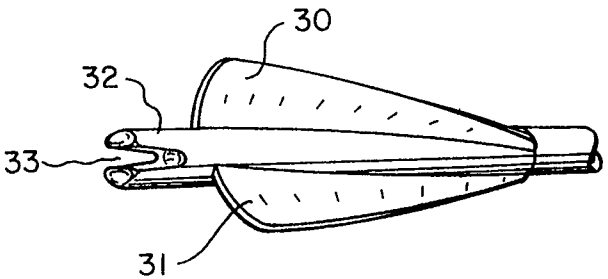

As shown, the arrow vane and nock assembly of the invention includes an elongate body 15, FIGS. 1, 2, 3, 4, and 5, with vanes 11 extending radially from the body and extending along a portion of the length of the body. Generally, either three or four vanes equally spaced around the circumference of the body will be used, three vanes being shown in the drawings. The vanes 11 may extend along the body parallel to the common axis of the body and the arrow, as shown in FIGS. 1–5, or, if desired to impart a spin to the arrow during flight, the vanes may extend along the body at an angle to the axis, as shown in FIG. 6.

An arrow shaft attachment means is provided at the forward end of the body. As shown, for use with a hollow arrow shaft 10, the arrow shaft attachment means may take the form of a reduced diameter forward extension 16 of body 15 which is sized to fit within hollow arrow shaft 10. While the outside diameter of forward extension 16 may be such as to fit snugly within arrow shaft 10, since there is normally a slight variation in the inside diameter of similarly sized arrow shafts, it is presently preferred to make the diameter of forward extension 16 slightly smaller than the expected inside diameter of a standard size hollow arrow shaft and provide longitudinal ridges 17, FIGS. 4 and 5, extending radially from the forward extension 16. The ridges 17 fit snugly within the arrow shaft. These ridges 17 have a slight resilience so accommodate for the slight variations in arrow inside diameter. Also, some archers may desire to glue the assembly in place in the arrow shaft and the ridges provide an area between them for the glue. Ridges of a height of five one-thousands of an inch (0.005") have been found satisfactory to accommodate the tolerance or variation of the inside diameter of a given size of arrow and to provide room for glue. With the above in mind, different size assemblies will be provided for different sizes of arrow shafts. While various types of glue, if desired, may be used to secure the assembly in the end of the arrow shaft, an advantage of the invention is that the assembly can be easily replaced in the arrow shaft. For this purpose, it has been found that a temperature sensitive adhesive, such as an adhesive normally referred to as hot glue, may be used. The glue will securely hold the assembly in the end of the arrow shaft under normal conditions, yet will readily release the assembly when the end of the arrow shaft is heated. It should also be noted that generally the assembly will fit snugly in the end of the arrow so no glue is really necessary.

Figure 2:
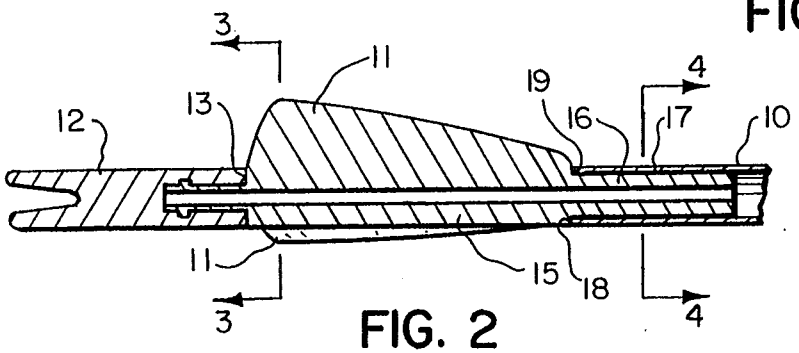
Figure 3:
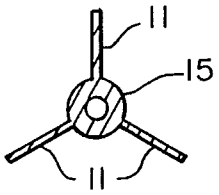
Figure 4:
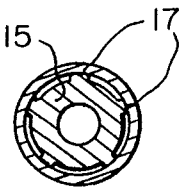
Figure 5:
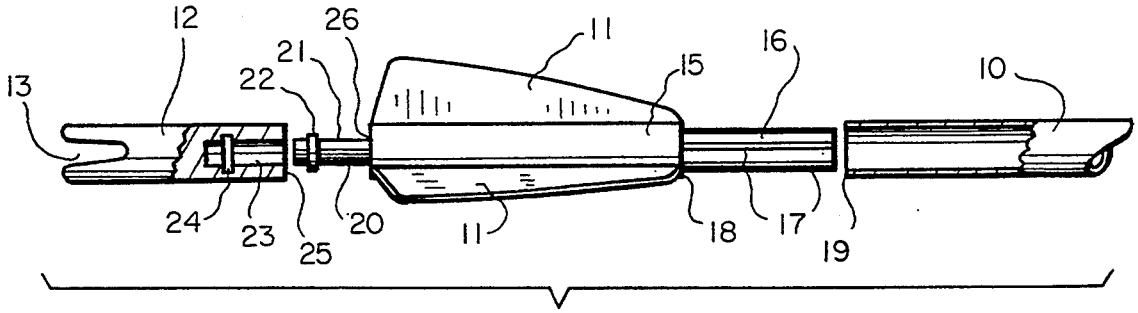

A shoulder 18, FIGS. 2 and 5, is generally formed between body 15 and forward extension 16 which serves as a stop for the assembly when inserted into arrow shaft 10. Thus, the rearward end 19 of arrow shaft 10 will abut shoulder 18 when the assembly is inserted into arrow shaft 10. The shoulder also allows body 15 to have an outside diameter equal to the outside diameter of the arrow shaft 10 so a smooth surface or transition occurs from arrow shaft 10 to body 15 extending behind arrow shaft 10.

While the nock portion of the assembly with bow string receiving groove may be integrally molded with the rest of the assembly as shown in FIG. 6, FIGS. 1–5 show a removable and replaceable nock. A nock attachment means, such as in the form of a reduced diameter rearward extension 20 of body 15, as shown, is provided at the rearward end of body 15 to receive and secure nock 12. Rearward extension 20 may be provided with longitudinal ridges 21 similar to ridges 17 on forward extension 16, and is also preferably provided with annular ridge 22. Nock 12 has a receiving opening 23 in its forward end to receive rearward extension 20 and also has an annular groove 24 in receiving opening 23 to receive annular ridge 22. Annular ridge 22 will deform as nock 12 is pushed over rearward extension 20 to allow nock 12 to be slid over extension 20 until forward end 25 of nock 12 abuts shoulder 26 of body 15 and at the same time, annular ridge 22 expands into and is received by groove 24. Again, longitudinal ridges 21 provide a snug fit in opening 23 and provide room for glue, if desired. Further, annular ridge 22 provides a holding means, which, when received in groove 24 as a mating holding means, provides further securement of nock 12 to body 15, and generally eliminates the need for glue. Longitudinal ridges 21 of five one-thousandths of an inch have been found satisfactory and it has been found satisfactory if annular ridge 22 extends five one-thousandths of an inch above ridges 21.

The advantage of the nock arrangement shown in FIGS. 1–5 is that the nock is easily replaceable and the alignment of bow string receiving groove 13 with respect to the vanes 11 can be easily adjusted as desired by the archer. Such adjustment is desired sometimes, for example, to accommodate different types of arrow rests. In addition, nocks of standardized size may be used with various sizes of the assembly.

Body 15 is preferably hollow, as shown in FIG. 2, to reduce weight and to avoid warping of the assembly during hardening of the assembly when such assembly is molded.

FIG. 6 shows an embodiment of the assembly with vanes 30 positioned on the body 31 so as to be at an angle to the axis of the body and arrow. Such positioning will cause the arrow to spin as it flies through the air. The embodiment of FIG. 6 also shows the nock 32 with string receiving groove 33 molded as an integral part of the assembly. The angled vane orientation could be used with a separate nock as shown in FIGS. 1–5 or the vane orientation parallel to the axis could be used with the integrally molded nock.

Figure 7:
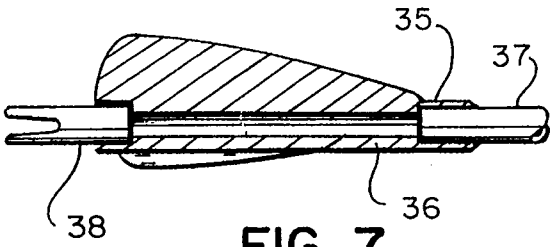

FIG. 7 shows an embodiment of the assembly wherein the forward end 35 of body 36 has an opening to receive the rearward end of an arrow shaft 37 to thereby secure the assembly to the end of the arrow shaft. Arrow shafts made of carbon fiber composite material are smaller in diameter than current aluminum arrow shafts and are not generally hollow so the attachment shown in FIG. 7 may be more advantageous for such arrow shafts. As shown in FIG. 7, the rearward end of the body 36 also has an opening therein to accept and hold a nock 38. Of course, an opening in the forward end of the assembly body to receive and hold an arrow shaft therein could be combined with an integrally molded nock or a rearward extension for the nock as shown in FIGS. 2–5, or the opening in the rearward end of the body to receive and hold a nock could be combined with the forward extension for securement to the arrow shaft as shown in FIGS. 2–5. Further, various other ways of securing the assembly to an arrow shaft or securing a nock to the assembly could be used.

The assembly of the invention may be made of various materials or combinations of materials and may provide rigid or flexible vanes. A glass filled or carbon fiber filled polycarbonate or nylon has been found satisfactory, but a variety of materials could be used. When using substantially rigid vanes with an assembly of the invention, it has been found that a vane length of about two inches behind the arrow shaft duplicates the performance of a conventionally fletched arrow using about five inch vanes of normal flexible plastic. With substantially rigid vanes, a satisfactory prototype of the assembly had a two inch long body with two inch long vanes extending therealong, a one inch forward extension to fit into the arrow shaft, and a one-half inch rearward extension over which a nock was placed. Tests indicated an arrow with such assembly traveled faster and flatter than an arrow using a similar arrow shaft but fletched in the conventional manner. Relatively stiff or substantially rigid vanes allow shorter vanes to be used than with conventional fletching, but a good arrow rest to keep the vanes from hitting the handle is necessary. Further, relatively stiff or substantially rigid vanes extending along the body reinforce the body to provide structural stability and rigidity to the assembly, even when the body is hollow.

A further aspect of the invention is to provide a nock for the assembly which can be held directly by a release device so a bow can be drawn by holding and drawing the nock of the arrow, thereby drawing the bow string by means of the nock, rather than drawing the bow string directly. In such instance, a nock 40, FIG. 8, may be used with the assembly in place of nock 12 shown in FIGS. 1–5. Nock 40 has the normal bow string receiving groove 41 and additionally includes annular groove 42 extending circumferentially around the nock. The annular groove 42 provides a catch receiving means to receive mating catch means on a release device.

Figure 10:
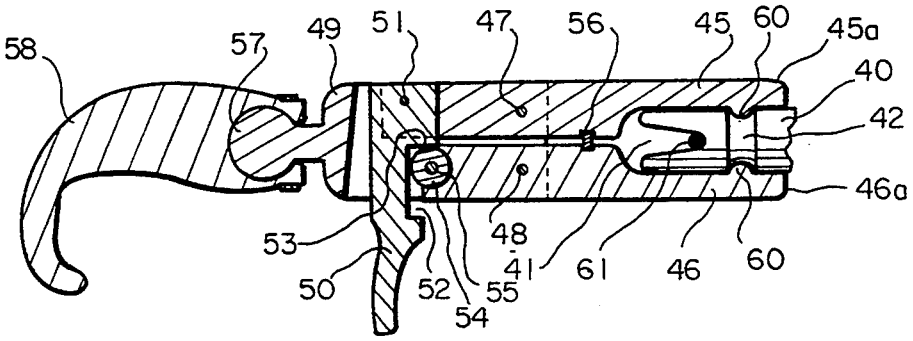

A conventional bowstring release device is modified so as to hold the nock of an arrow rather than the bow string as is normally done. Thus, jaw members 45 and 46 are pivotally mounted by pivot pins 47 and 48, respectively, to housing 49. A trigger 50 is pivotally mounted by pivot pin 51 to jaw member 45 and has a cut away area 52 forming a trigger shoulder 53. A roller 54 mounted for rotation on jaw member 46 by pin 55 is positioned to be held against shoulder 53 to hold jaws 45 and 46 in a fixed or closed position when trigger 50 is in locking position as shown in FIG. 10. If trigger 50 is pivoted rearwardly from the position shown in FIG. 10, shoulder 53 moves rearwardly releasing roller 54. The jaw members can then pivot about pivot pins 47 and 48 so that jaw end portions **45*a* and 46*a* move apart to open position. The trigger 50 thus forms a user operated means for selectively holding the jaws in closed position or for allowing the jaws to move to open position. A spring 56 biases the jaws to open position. Housing 49 has a ball portion 57 at its rearward end with a handle 58** mounted thereon for free movement. This allows the handle to move and twist with a user's hand during drawing of a bow without transmitting twisting forces to the arrow or bow string.

Figure 8:
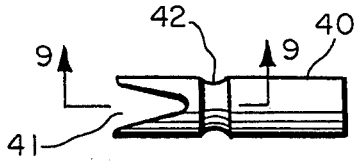
Figure 9:
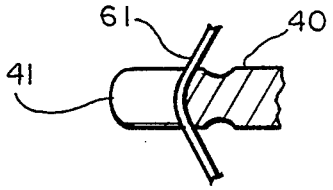
Figure 11:
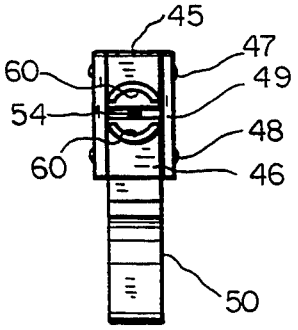

The ends **45*a* and 46*a* of jaws 45 and 46, respectively, are configured to conform to and partially surround the sides of an arrow nock. As illustrated, the end portions of the jaws are rounded as shown in FIG. 11, to partially surround the sides of a nock 40 as shown in FIG. 8. Ridges 60, FIG. 10, form catch means and are provided in jaw end portions 45*a* and 46*a* to mate with groove 42 in nock 40 to thereby securely hold nock 40 as shown in FIG. 10 when the jaws are in closed condition. In this way, an arrow may be positioned for shooting with respect to an archery bow so that the bow string 61, FIG. 10, is in bow string receiving groove 41 of nock 40 when the bow is in its rest or undrawn position. The release device with jaws 45 and 46 in open position is placed adjacent the nock and the jaws closed and locked into position as shown in FIG. 10. The user then draws the bow by drawing the release device which draws the bow string 61 by drawing the arrow. As the arrow is moved or drawn, the bow string 61 in bow string receiving groove 41 is also moved to its drawn condition. It is preferred that bow string receiving groove 41 have a curved configuration as shown in FIG. 9 so that the natural curve of the bow string 61 in drawn condition is maintained, as shown, through the bow string receiving groove 41. When the bow is drawn and aimed, trigger 50 is moved rearwardly to release jaws 45 and 46 to move to open position. This releases nock 40 which also releases bow string 61** so the arrow is shot from the bow. It has been found that by holding the arrow, rather than the bow string, with the release device, more even forces are applied to the arrow upon release. This results in more accurate shooting. If it is desired to put an upward or downward force on the end of the arrow when shot, the curve in the bow string receiving groove, as shown in FIG. 9, can be modified accordingly.

The use of a release device adapted to hold the nock of an arrow is not limited to use specifically with the vane and nock assembly of the invention, but could be used with any type of arrow configured to mate with and be held directly by the release device. Thus, a nock adapted to be attached to the end of a conventionally fletched arrow shaft in normal manner could be configured with catch receiving means to receive mating catch means held by the release device. Further, the configuration of the catch receiving means and catch means can vary and the positioning on the nock can vary. For example, the catch receiving means on the nock could take the form of various types of grooves or indentations or various types of projections, while the mating catch means could be various mating projections or various mating grooves or recesses, respectively. Further, the respective catch receiving and catch means may be positioned behind the bowstring, but in such case, it is necessary to have an insert in the bow string receiving groove to keep the two sides of the groove apart.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A vane and nock assembly for use with an archery arrow shaft to make an archery arrow, said arrow shaft having a rearward end beyond which no part of the arrow shaft extends, comprising a single elongate body having a length, a forward end, and a rearward end; a plurality of vanes projecting from the body and extending along at least a portion of the length of said body, each vane being a single elongate piece molded integrally with the body; arrow shaft attachment means at the forward end of said body for attaching the vane assembly to the rearward end of an arrow shaft and preventing the arrow shaft from extending into the body beyond the attachment means so that the portion of the body with the vanes projecting therefrom is located entirely rearwardly of the rearward end of the arrow shaft; and nock means at the rearward end of said body.

2. A vane and nock assembly according to claim 1, wherein the arrow shaft with which the assembly is to be used is hollow, and the arrow shaft attachment means includes a reduced diameter forward extension of the body adapted to be received within the hollow arrow shaft.

3. A vane and nock assembly according to claim 2, wherein the forward extension includes longitudinal ridges thereon which snugly fit into the hollow arrow shaft.

4. A vane and nock assembly according to claim 1, wherein the arrow shaft attachment means includes an opening at the forward end of the body to receive the rearward end of an arrow shaft therein.

5. A vane and nock assembly according to claim 1, wherein the nock means includes a nock attachment means at the rearward end of the body and a nock cooperable with the nock attachment means.

6. A vane and nock assembly according to claim 5, wherein the nock attachment means includes a reduced diameter rearward extension of the body adapted to be received within a nock, and the nock includes an opening to receive the rearward extension of the body to thereby secure the nock to the body.

7. A vane and nock assembly according to claim 6, wherein the rearward extension includes holding means thereon, and the nock opening includes mating holding means to mate with the holding means on the rearward extension to thereby more securely hold the nock in place on the rearward extension.

8. A vane and nock assembly according to claim 7, wherein the holding means is an annular ridge extending from and around the rearward extension and the mating holding means is an annular groove extending around the nock opening whereby the annular ridge is received in the annular groove.

9. A vane and nock assembly according to claim 5, wherein the nock attachment means includes an opening at the rearward end of the body to receive the forward end of a nock therein.

10. A vane and nock assembly according to claim 5, wherein the nock includes catch receiving means adapted to receive mating catch means on a release device whereby the release device can securely hold the nock against the force of a bow string during draw of a bow wherein the drawing force is applied to the bow string by the nock.

11. A vane and nock assembly according to claim 10, wherein the catch receiving means is an annular groove about the nock adapted to receive opposing ridges on opposing jaws of a release device.

12. A vane and nock assembly according to claim 10, additionally including a release device cooperable with the nock, said release device comprising opposing jaws movable between a closed position wherein holding ends of said jaws are held in fixed position, and an open position wherein the holding ends of said jaws are moved from their fixed position; user operated means for selectively holding said jaws in closed position or for allowing said jaws to move to open position; and catch means on said jaws cooperable with the catch receiving means on said nock whereby in closed position the catch means on said jaws cooperate with the catch receiving means on said nock to securely hold the nock between said jaws against the force of a bow string during draw of a bow and in open position the nock is released from between the jaws.

13. A vane and nock assembly according to claim 12, wherein the catch receiving means is at least one recess in the nock and the catch means is at least one projection which mates with the at least one recess when the jaws are in closed position with the nock therebetween.

14. A vane assembly for use with an archery arrow shaft to make an archery arrow, said arrow shaft having a rearward end beyond which no part of the arrow shaft extends, comprising a single elongate body having a length, a forward end, and a rearward end; a plurality of vanes projecting from the body and extending along at least a portion of the length of said body, each vane being a single elongate piece molded integrally with the body; arrow shaft attachment means at the forward end of said body for attaching the vane assembly to the rearward end of an arrow shaft and preventing the arrow shaft from extending into the body beyond the attachment means so that the portion of the body with the vanes projecting therefrom is located entirely rearwardly of the rearward end of the arrow shaft; and nock attachment means at the rearward end of said body for attaching a nock to the vane assembly.

15. A vane assembly according to claim 14, wherein the nock attachment means includes a reduced diameter rearward extension of the body adapted to be received within a nock to be attached to the assembly.

16. A vane assembly according to claim 14, wherein the nock attachment means includes an opening at the rearward end of the body to receive a forward end of a nock therein.

17. A vane assembly according to claim 14, including a nock, comprising a nock body; a bow string receiving groove; means for mating the nock to the nock attachment means; and catch receiving means adapted to receive mating catch means on a release device whereby the release device can securely hold the nock against the force of a bow string during draw of a bow wherein the drawing force is applied to the bow string by the nock.

18. A vane assembly according to claim 17, wherein the catch receiving means is at least one recess in the nock.

19. A vane and nock assembly according to claim 13, wherein the catch receiving means is an annular groove extending around the nock, and the catch means is a ridge extending from each of the jaws to partially surround the nock and be received by the annular groove when the jaws are in closed position with the nock therebetween.

* * * * *